United States Patent [19]

Schwarz

[11] Patent Number: 4,546,816

[45] Date of Patent: Oct. 15, 1985

[54] METHOD AND APPARATUS OF CONTINUOUSLY CASTING HOLLOW ROUND BILLETS WITH A HYPOCYCLOIDAL MANDREL AND AN INSIDE ROLLING PROCESS

[76] Inventor: Gerhard E. Schwarz, 33020 Lake Rd., Avon Lake, Ohio 44012

[21] Appl. No.: 551,509

[22] Filed: Nov. 14, 1983

Related U.S. Application Data

[63] Continuation of Ser. No. 233,556, Feb. 11, 1981, abandoned.

[51] Int. Cl.[4] ..... B22D 11/00

[52] U.S. Cl. ..... 164/465; 164/421

[58] Field of Search ..... 164/464, 465, 421, 422

[56] References Cited

U.S. PATENT DOCUMENTS

| | | | |
|---|---|---|---|
| 3,268,959 | 8/1966 | Babel et al. | 164/465 |
| 3,409,068 | 11/1968 | Yearley et al. | 164/465 |
| 3,416,591 | 12/1968 | Babel et al. | 164/465 |
| 3,593,773 | 7/1971 | Vogt et al. | 164/4 |
| 3,638,715 | 2/1972 | Simon | 164/465 |

FOREIGN PATENT DOCUMENTS

| | | | |
|---|---|---|---|
| 866237 | 12/1952 | Fed. Rep. of Germany | 164/421 |
| 46-12621 | 4/1971 | Japan | 164/465 |
| 502703 | 4/1976 | U.S.S.R. | 164/464 |

OTHER PUBLICATIONS

U.S. and Foreign Patent Abstracts, Berg-und Huttenmannische Monatshefte, pp. 318 and 319.

Stahl u. Eisen 86, (1966), pp. 345 and 346.

Fachbenchte Hottenpraxis Metallwerterverarbeitung, vol. 20, p. 829, 1982, Exhibit I, Exhibit II, Exhibit III.

*Primary Examiner*—Kuang Y. Lin

*Attorney, Agent, or Firm*—Maky, Renner, Otto & Boisselle

[57] ABSTRACT

The invention provides an apparatus and process to cast continuously high quality hollow round steel billets or tubes. The hollow round steel billets are produced by a compact, high production casting machine incorporating a rotating hypocycloidal mandrel for inside cooling and deformation of the solidified steel. The outside cooling is by traditional mold and spray cooling. The adjustable rolling movement of the mandrel controls the uniform heat extraction from the inner annulus as well as the deformation and deformation rate of the as-cast steel to increase the ductility. The inside of the hollow round billet so formed is substantially round and the inside surface is smooth to facilitate high quality and further processing to finished pipes in conventional high production machinery.

31 Claims, 9 Drawing Figures

INVENTOR:
GERHARD E. SCHWARZ

INVENTOR:
GERHARD E. SCHWARZ

INVENTOR:
GERHARD E. SCHWARZ

INVENTOR:
GERHARD E. SCHWARZ

INVENTOR:
GERHARD E. SCHWARZ

INVENTOR:
GERHARD E. SCHWARZ

INVENTOR:
GERHARD E. SCHWARZ

METHOD AND APPARATUS OF CONTINUOUSLY CASTING HOLLOW ROUND BILLETS WITH A HYPOCYCLOIDAL MANDREL AND AN INSIDE ROLLING PROCESS

This application is a continuation of application Ser. No. 233,556 filed Feb. 11, 1981, now abandoned.

TECHNICAL FIELD

The present invention relates generally to apparatus and method for casting, and, more particularly, to apparatus and method for continuously casting hollow round billets, tubes and the like.

BACKGROUND OF THE INVENTION

Continuous casting in general is a process by which the uninterrupted flow of molten metal enters one end of the casting apparatus, is solidified, and is withdrawn at the other end having the desired configuration. Continuous casting of steel for high quality steel products, such as pipes, tubes and the like, of necessity must be carefully controlled. For example, the casting temperature of the molten metal has to be maintained within a certain range during the cast. To assure the internal and surface quality of the finished product, defects, such as porosity, cracks, segregation and inclusions of the casting, should be minimized or be such that they are not harmful. This requires controlled feeding of liquid metal, casting speed and cooling rate.

Continuous cast steel usually is hot deformed in further processes to produce a homogeneous end product with acceptable quality and soundness. The deformation from the cast size to finished size usually would be at least 4:1 and could be as high as 15:1 for some products. To withstand successfully such further deformation while desired quality of the end product is achieved, the cast material must be of high quality with minimum defects as aforesaid.

For reasons of economy it is desirable to maximize the amount of liquid steel cast as a batch or heat. Heats of 200 tons of liquid steel are common. Heats of 300 tons or more are in operation or proposed. To cast such large amounts of liquid steel within a certain time and at an acceptable speed, multiple strands per machine are required; but it has been found that the maximum should not exceed six strands from the operational and engineering standpoint. For example, to cast 200 tons of liquid steel the casting time should not be more than 90 minutes. For solid billets casting speeds of over 100 inches per minute are reported but most machines have casting speeds between 30 and 80 inches per minute.

In modern casting machines for steel a distributor or tundish feeds molten metal into the molds of the individual strands. Metering is by stopper rod or sliding gate made of high temperature refractory. A water cooled oscillating mold initiates the solidification process. As soon as a crust of sufficient thickness and strength is formed by the mold, water spray cooling is applied to complete the solidification process.

The cross section of the cast steel is determined by the intended subsequent deformation to finished product and the casting mold and an adequate opening in the tundish to feed steel into the mold are, accordingly, appropriately sized. The tundish opening should be sufficient to prevent clogging. Furthermore, a large mold size favors flotation of liquid steel impurities which easily could be trapped in the solidifying steel. It is generally agreed that the minimum thickness of cast steel should not be less than 4 inches.

Since continuous casting has proven to be an energy saving process for steel production with higher overall productivity for capital investment and labor than other steel manufacturing processes, it has found increasing acceptance. Approximately 21% of the world steel production in 1979 was continuously cast, but the percentage was less for the steel pipes.

For relatively high production of seamless steel pipes from solid round billets, conventionally such solid billets are pierced to form hollow round billets (or hollow rounds) which then are further processed by various operations to form finished pipes. The solid round billets themselves are produced either by the traditional ingot process with the ingots being rolled to billet size or by casting billets on a continuous casting machine. Billets can be cast to size or cast at a relatively larger section and then rolled to desired billet size. One problem using such technique, though, is that continuously cast billets usually have internal defects generally concentrated towards the axial center thereof. Such defects are a cause for inside quality problems of the finished pipe produced therefrom.

To avoid using the above mentioned piercing process and its attendant disadvantages in forming hollow round from solid round, attempts have been made to cast directly hollow round billets. The aforesaid defects, then, would be confined internally of the billet wall, i.e. not at the external or internal wall surfaces of the hollow billet. Therefore, such internally confined defects would not detrimentally affect the inside or outside surface quality of the finished pipe.

In one prior casting machine hollow rounds were cast directly in a U-shape mold with withdrawal in an upward direction. Such machine was based on the principle of "Communicating Vessels" and no internal plug was required. However, such machine has not been widely commercially accepted.

Hollow round steel billets also have been cast by a centrifugal process. This process has found particular application for stainless steel and special alloy steel pipes with limited production.

On an experimental and low production basis hollow round has been cast using an internal water cooled plug for primary inside cooling and water spray for secondary inside cooling. The plug normally oscillates with the outside mold. However, casting hollow round with such internal plug and spray cooling has encountered many problems. For example, internal explosions have occurred after an internal breakout when liquid steel has come in contact with water or steam. Venting and detecting devices, therefore, are necessary to avoid explosive conditions, but such devices increase the complexity of the equipment and do not necessarily assure that explosions will be avoided.

Another problem encountered by such latter type of direct casting machines has been the contracting of the inner annulus of the solidifying steel as it cools and the freezing thereof to the plug. The friction forces between plug and annulus, then, cause cracking and rehealing to the inside surface thereof, which is detrimental to the inside surface quality of the finished pipe. Tapered and corrugated plug surfaces in addition to the oscillation as well as an expandable/contractable plug have been suggested and tried to try to overcome these problems but have not been totally successful.

The as-cast macro-structure of the material formed by the prior techniques for direct cating of hollow rounds has not been particularly suitable for further processing in an elongator. Processing the hollow rounds in an elongator is the first step in high production mills to reduce the wall thickness. Two or three contoured rolls with inclined axes rotate the billet and advance it over an internal mandrel. The billet rotates around its axis with a surface speed between 800 and 1200 feet per minute imposing tangential stresses on the inside and outside surface by the centrifugal forces. Since the tangential stresses on the inside surface far exceed the stresses on the outside surface, the relative low strength of the macrostructured material often will rupture inside reducing the quality of the finished product. Hollow round billets cast with a plug and inside spray cooling have been processed in presses or in a pilgrim mill which forges the wall axially. After every forging process the billet is turned 90°. These processes, though, are low production operations and are economical only in certain cases.

Further, it has been found that the wall thickness of the hollow round billets formed by prior direct casting techniques varies over the whole length. Such variations could detrimentally affect the wall tolerance of the finished pipe. Using additional plugs in the secondary cooling zone centered by a magnetic field has been suggested for improvement of wall thickness uniformity.

It will be appreciated that it would be desirable to eliminate the aforesaid problems encountered in making hollow round billets, tubes and the like, especially by direct continuous casting. Both external and internal surface defects should be avoided and good ductility should be maintained to permit facile, high speed elongation while quality of the finished product is held. It also is desirable to maximize production speed, to minimize machine space requirements and to minimize capital and labor costs.

SUMMARY OF THE INVENTION

According to the present invention there is provided an apparatus and process to cast hollow round steel billets or tubings. The casting machine apparatus is compact and capable of high production operation. The hollow round billets produced are of superior quality and can be processed in known operations to finished pipes, especially in high production installations.

Fundamentally, the apparatus includes a fixed ring-like water cooled mold or die, forming an annular ring area into which molten steel is delivered from a tundish or the like. The axial length of such ring area is adequately long to allow sufficient cooling of the cast steel passing axially therealong such that a containment skin is formed to contain molten steel therewithin before the casting leaves the ring area. Axially beyond the ring area is a movable mandrel inside the casting. The mandrel has several functions including cooling the inside surface of the casting by direct rolling engagement therewith and applying force radially to the inside surface of the casting holding constant the round or cylindrical hollow interior of the casting while enhancing subsequent ductility. Preferably there is minimum relative slippage between the mandrel surface and the inside surface of the casting; this enhances the cooling and force aplying functions while maintaining the high quality characteristic of the inside surface of the casting. Therefore the mandrel is of somewhat smaller diameter than the inside diameter of the casting and is water cooled.

The mandrel is rotated in engagement with the inside surface of the casting such that each point at the circumference of the mandrel describes a hypocycloidal curve or a curve which is close to a hypocycloid. The mandrel is referred to below, therefore, as a hypocycloidal mandrel and the process may be referred to as an inside rolling process. The hypocycloidal mandrel is rotated by two concentric shafts that rotate independently of each other. The inside of the mandrel body is connected to the shafts by a link mechanism.

The mandrel structure includes an inner steel structure and enveloping the inner structure a hollow cylinder made from material with high thermal conductivity. A gap between these two members provides a flow path for the cooling water.

Although the relative movement between the mandrel and inside surface of the casting is very small, friction that does exist therebetween, for example due to differential expansion of the casting along the length of the mandrel as the casting cools, could be reduced by applying a suitable oil to the interfacial surface. Also to correct for slippage between the mandrel and casting each shaft may be driven individually by respective motors at least one of which should have a continuously variable speed control.

Efficient extraction of heat from the inside of the hollow round billet or casting is by conduction transfer by direct contact with the outside cylinder of the mandrel and convection transfer from the cylinder to flowing water in the mandrel. A pipe extension at the end of the mandrel may have spray nozzles to spray cooling water on the inside surface of the casting. The heat extracted at the inside of the hollow round, then, will be by a combination of conduction and convection by the mandrel and spray cooling. The length of the mandrel should be such that an internal breakout, i.e. release of molten steel from containment within the body of the casting by the skin thereof, is impossible. The rotating nozzles help to assure unform cooling of the inner annulus.

The water cooled stationary die immediately above the hypocycloidal mandrel has the same diameter as the inside diameter of the hollow round billet being cast. The hypocycloidal mandrel, rotating at a predetermined speed, continues the inside solidification process of the casting as it passes from the die to the mandrel. The direction of the rotation is immaterial, and the speed of the mandrel is determined by the rate of heat extraction and the deformation rate of the casting material.

As the casting cools, the thickness of the solidified inner annulus increases, the volume of steel changes, and the inside diameter decreases. Such inside diameter decrease would tend to freeze the inner annulus to a stationary cylindrical mandrel by the shrinkage forces, and the ferro static pressure of the liquid core of the casting would add to such forces. However, the total of such forces is counteracted normal to their line of action by the hypocycloidal mandrel as it is rotated about the hollow interior of the casting. Such counteraction is in compression thus avoiding or minimizing any shearing which might rupture or tear the sensitive inner skin improving safety of operation and smoothness and roundness of the inside surface of the hollow round.

A hypocycloidal mandrel in accordance with the invention having cylindrical configuration would deform the inner annulus by the amount of shrinkage and at a rate that is a function of the mandrel rotational speed. Such deformation could be increased or decreased by tapering the mandrel. Moreover, such deformation will increase the ductility of the cast steel.

The combined heat extraction at the inside and outside of the cast billet, withdrawal speed and the wall thickness of the billet determine the metallurgical length. It is independent of the diameters. The metallurgical length is an important design factor for the length of the mandrel and the length of the casting machine and desirably should be minimized.

The casting machine for hollow round billets with the hypocycloidal mandrel in accordance with the invention may be a sraight or stick machine or alternatively a straight-bend machine. The straight portion of both types of machines is normally, but not necessarily exclusively, vertical. In a stick machine casting, solidification and cutting to billet length is accomplished while the billet is vertically oriented. The billet is tilted to a horizontal position for run-out. In a straight-bend machine casting and solidification are accomplished while the billet is vertically oriented; after the billet has or almost has solidified, it is bent to a horizontal orientation and then cut to billet length for run-out.

With the forcegoing in mind, a primary object of the present invention is to provide an apparatus and method for continuous casting of hollow round billets or the like improved in the noted respects.

Another object is to facilitate cooling and to effect the same in an efficient manner in continuous cast hollow round.

An additional object is to expedite cooling of continuous cast hollow round.

A further object is to minimize the metallurgical length of cast hollow round.

Still another object is to reduce the cost of manufacturing hollow round billets, especially by a continuous casting method.

Still an additional object is to improve the quality of hollow round billets, including, for example, surface quality, ductility, deformability, and of the end product formed therefrom.

Still a further object is to increase the speed of production of cast hollow round billets.

Even another object is to facilitate subsequent deformation of hollow round billets.

Even an additional object is to minimize the cost for equipment and labor to manufacture hollow round billets and to minimize the size of such equipment and/or the space required therefore.

Even a further object is to provide a rotating mandrel, especially of hypocycloidal type, for use in manufacturing hollow round billets, especially of steel.

Yet another object is to improve the safety in manufacturing hollow round billets, especially by a continuous direct casting method.

Yet an additional object is to provide an inside rolling process for use in the manufacturing of hollow round billets.

Yet a further object is to prevent freezing of a continuous cast hollow round billet to an internal mandrel or die.

Yet even another object is to maintain uniformity in continuous directly cast hollow round billets.

These and other objects and advantages of the present invention will become apparent as the following description proceeds. p To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
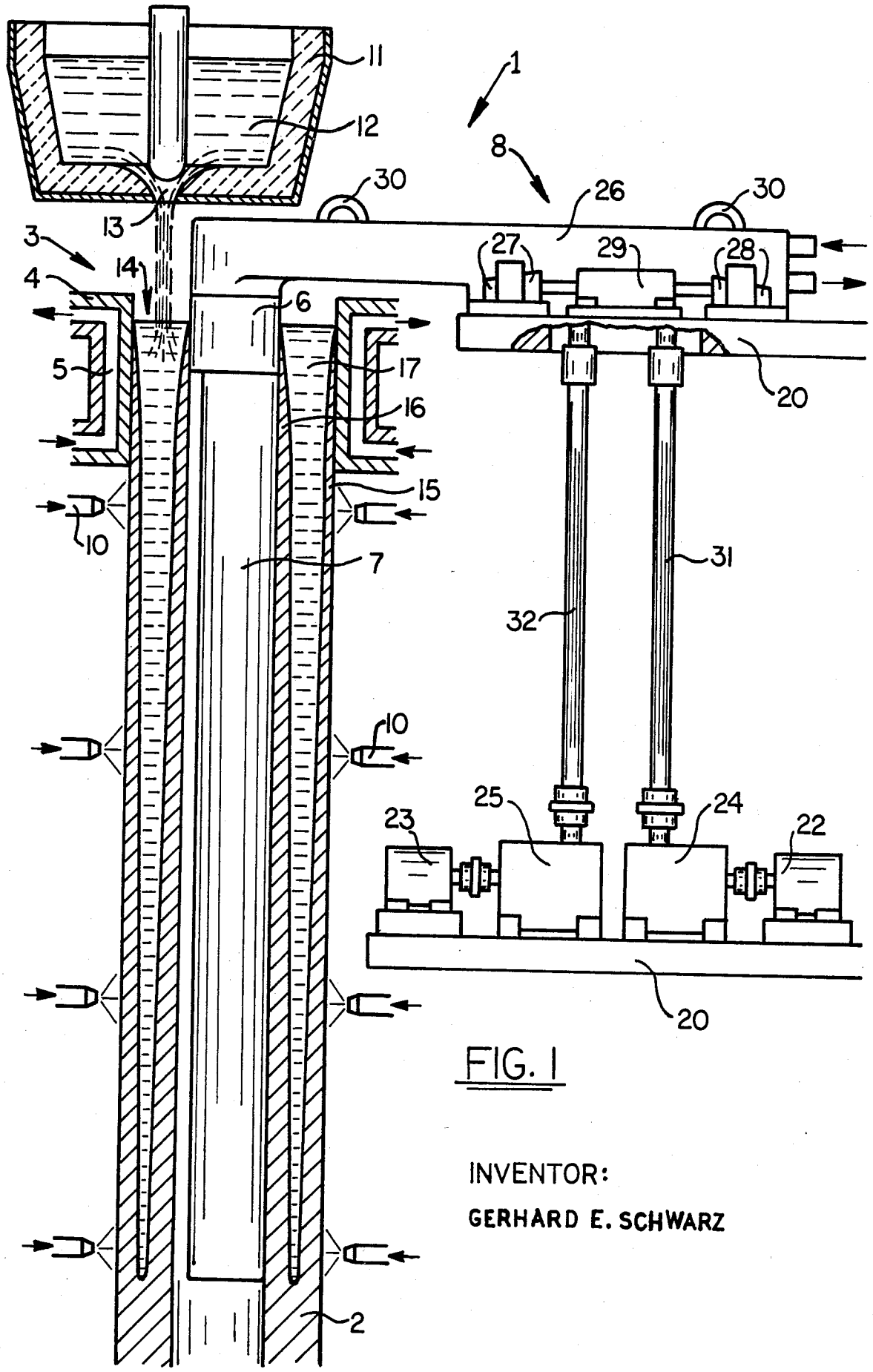
FIG. 1 is a schematic elevation view, partly broken away in section, of a hollow round continuous casting machine in accordance with the present invention.

Referring now in detail to the drawings, wherein like reference numerals designate like parts in the several figures, and initially to FIG. 1, a continuous casting machine for casting hollow round billets or the like, generally referred to herein as billets or castings, of steel or other material is generally indicated at 1. The casting machine 1 is shown in the process of casting a single hollow round billet or casting 2; however, it will be appreciated that the machine 1 may include means for simultaneously casting plural strands or castings 2. In the preferred embodiment the machine 1 would be capable of simultaneously casting plural strands.

The machine 1 includes a ring-shape mold assembly 3, which is formed by a conventional cylindrical mold 4 cooled by water flowing through one or more passages 5 therein and a fixed cylindrical mandrel 6, a rotatable hypocycloidal mandrel 7, and a drive assembly 8 for rotating the mandrel 7. Nozzles 10 may be provided to spray cooling water or other material on the outer surface of casting 2 after the latter has left the ring-shape mold assembly 3 further to cool the casting. A tundish 11 delivers molten steel 12, or other material, as desired, via a conventional valve 13 to the material inlet end 14 of the ring-shape mold assembly 3.

It is the purpose of the fixed mandrel 6 to commence cooling of the casting 2 to effect initial formation of the inner annulus 16; it is the purpose of the hypocycloidal mandrel 7 to continue such cooling thereby to further solidification and formation of the inner annulus 16 while also preferably applying a compression force thereto ultimately to increase ductility and surface quality of the finished casting.

Ordinarily molten steel delivered into the ring-shape mold assembly 3 forms a molten cylindrical annulus near the inlet end 14, the boundary of that annulus being defined by the confronting surfaces of the mold 4 and fixed mandrel 6. The portions of such ring of molten steel in contact with or at least near the cylindrical mold 4 or fixed mandrel 6 begin to cool and, therefore, to solidify due to contact therewith. An outer annulus 15 and an inner annulus 16 of the casting 2, then, begin to form and define boundaries for containment of still liquid molten steel 17 therewithin. Preferably the axial lengths of the mold 4 and fixed mandrel 6 are such that the strength of the respective annuli 15, 16 is adequate to contain the molten steel 17 without break-out thereof when the casting leaves the ring-shape mold assembly 3; moreover, the axial length of the fixed mandrel 6 preferably is sufficiently short to avoid the possibility of freezing of the casting thereto as the casting solidifies and the diameter of the inner hollow volume thereof shrinks. Preferably the axis of the ring-shape mold assembly 3 is oriented substantially in a vertical direction, as is shown, for example, in FIG. 1, to use gravity to help draw the casting 2 down out from the ring-shape mold assembly 3. Additional conventional means also may be used to draw the casting 2 from the mold assembly 3; such further means also may include conventional cut-off means for cutting the casting 2 into discrete sections.

The machine 1 is located in a building, for example, being secured to fixed support structures, such as floors or beams 20 which are illustrated in FIG. 1. Electric motors 22, 23 and gear assemblies 24, 25 in the drive assembly 8 are mounted on the fixed building support 20, and a machine housing portion 26 also is mounted on a building support 20. The fixed mandrel 6 and the hypocycloidal mandrel 7 are supported by the housing 26, as can be seen more clearly in FIG. 2. The housing 26 may be bolted to the support 20 or may be held thereto by wedges 27, 28 which are moved by a hydraulic cylinder arrangement 29. When the hydraulic pressure is relieved, for example, on the cylinder 29, the housing 26, including the mandrels 6, 7 may be lifted by an overhead crane attached to eyes 30.

To achieve the desired rotational format for the hypocycloidal mandrel 7, such mandrel is rotated about its own axis, and that axis in turn is moved around a further axis, as will be described in greater detail below. To achieve such movement of the mandrel 7, rotational input is provided from the respective motors 22, 23 and gear assemblies 24, 25 via drive shafts 31, 32. The hypocycloidal mandrel 7 is mounted on inner and outer shafts 35, 36, which are turned by chain drive connections 37, 38 to the respective drive shafts 31, 32, as is shown most clearly in FIG. 2. The drive shafts 31, 32 are rotatably mounted in the housing 26 by bearings 39, and the inner and outer shafts 35, 36 similarly are mounted for support by the housing 27 in concentric relation by respective bearings 40.

Figure 2:
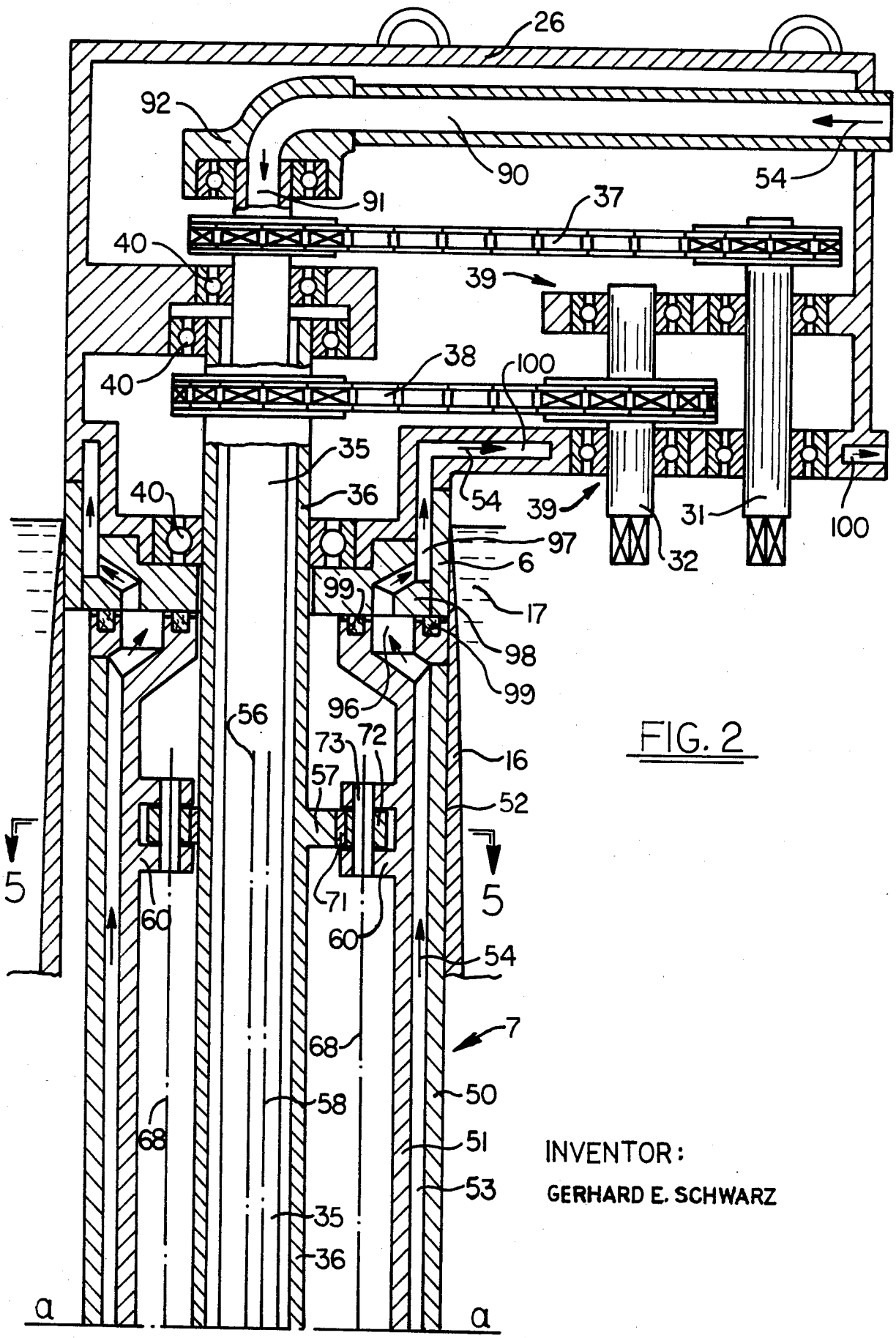
FIGS. 2 and 3 are section views through the hypocycloidal mandrel of the machine of FIG. 1, line a—a being the line of continuation between FIGS. 2 and 3.
Figure 3:
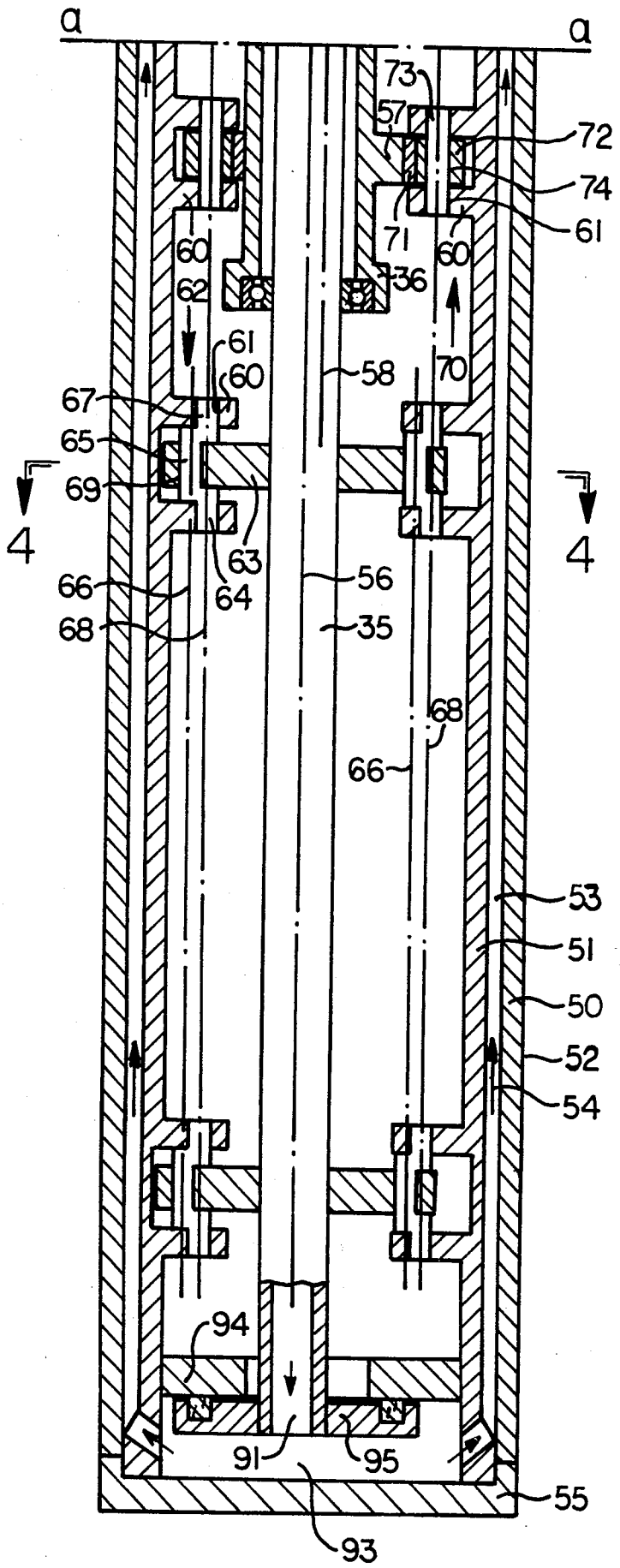

Referring now in detail to FIGS. 2 and 3, the hypocycloidal mandrel 7 is formed by concentric outer and inner cylinders 50, 51. The outer cylinder 50 preferably is formed of highly thermally conductive material to effect efficient thermal energy transfer with respect to the surface 52 of the inner annulus 16 over which such cylinder rolls. The inner cylinder 51 strengthens the hypocycloidal mandrel 7, facilitates mounting thereof, and defines with the outer cylinder 50 a gap 53 through which water may flow, as is indicated by the arrows 54 to effect the desired cooling. The cylinders 50, 51 preferably are mechanically connected at the bottom ends thereof, for example by mechanical means including a plate or cap 55, and additional means may be provided as well to effect mechanical interconnection of the cylinders to maintain their fixed relative relation as a substantially integral body forming the hypocycloidal mandrel.

Both the inner and outer shafts 35, 36 are concentrically mounted by the bearings 40 relative to the housing 26 for rotation about a common axis 56. Rotation of the inner shaft 35 provides the rotational input to rotate the hypocycloidal mandrel 7. However, circular cross-section displacement shanks 57 axially displaced along the outer shaft 36 cause the hypocycloidal mandrel 7 actually to rotate about an axis 58, as will be described further below. The shanks 57 are generally of cylindrical formation having a limited axial extent relative to the length of the outer shaft 36; the axis 58 is the center axis of the cylindrical displacement shanks 57.

For connecting the mandrel cylinders 50, 51 to the inner shaft 35, the inner cylinder 51 has in its lower end a plurality of internal lugs 60 all of which are of the same size and respective groups of which are axially aligned, as will become more apparent from the following description. More specifically, each of the lugs 60 has a central bore 61. A first linking mechanism 62 for mechanically coupling the inner shaft 35 to the lugs 60 includes a contoured plate 63, which is fixedly attached to the inner shaft 35 by means not shown, and eccentric pins 64, each of which has a cylindrical mid portion 65 generally aligned with a respective axis 66, and offset end portions 67 generally aligned with a further axis 68. The mid portion 65 passes through a bore 69 in the plate 63, and the end portions 67 pass through the bores 61 in the lug 60. The eccentricity of the eccentric pins 64 is defined as the spacing between the axes 66, 68, and such spacing will be the same as the spacing between the axes 56, 58; and all of such axes are parallel, as is illustrated.

For connecting the mandrel cylinders 50, 51 to the outer shaft 36, lugs 60 in the upper end of inner cylinder 51 are coupled to the outer shaft by a second linking mechanism 70. The second linking mechanism 70 includes the displacement shank 57, a bearing sleeve 71, a further contoured plate 72, and straight pins 73, which pass through bores 61 in the lugs 60 and through a bore 74 in the plate 72. The bearing sleeve 71 allows the contoured plate 72 and the outer shaft 36 to rotate independently; the circular or cylindrical displacement shank 57, though, translates or rotates the axis 58 about which the hypocycloidal mandrel 7 rotates about the axis 56 in direct response to rotation of the outer shaft 36.

Figure 4:
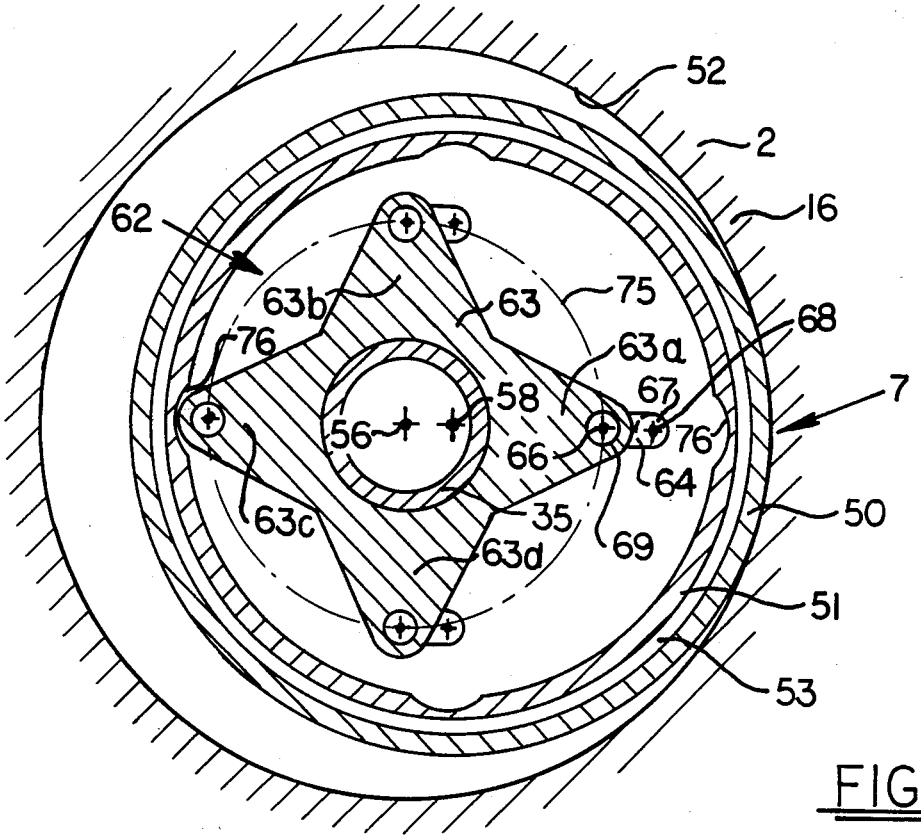
FIG. 4 is a section view of the hypocycloidal mandrel looking generally in the direction of the arrows 4—4 of FIG. 3.
Figure 5:
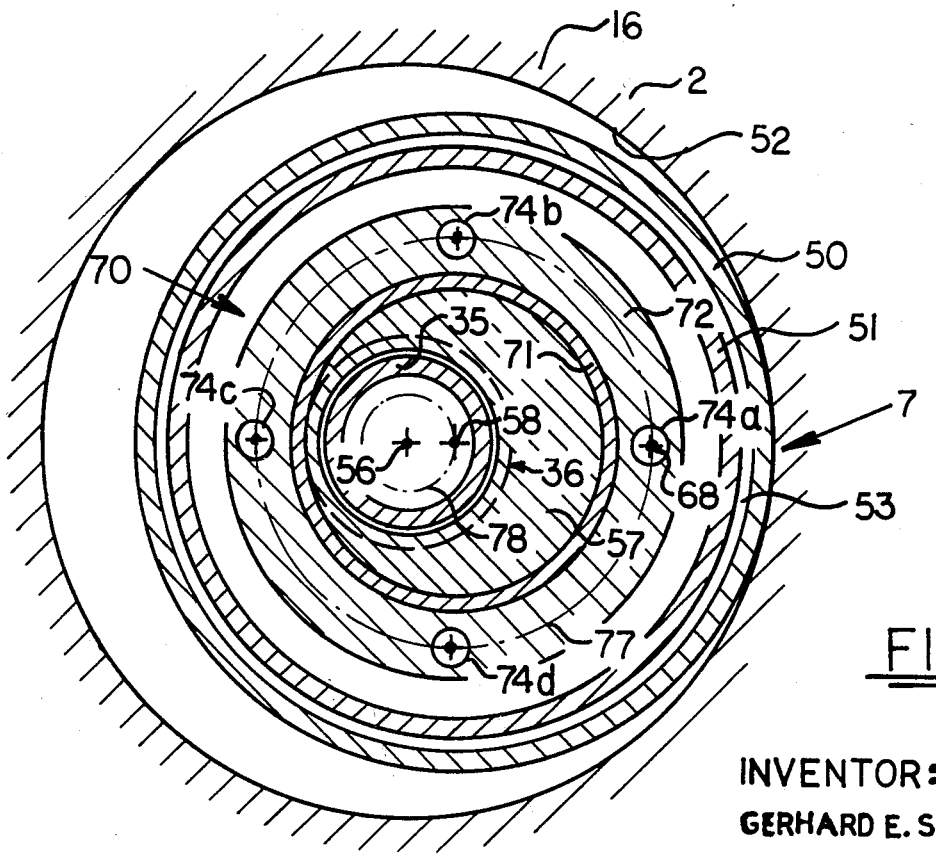
FIG. 5 is a section view of the hypocycloidal mandrel looking generally in the direction of the arrows 5—5 of FIG. 2.

Briefly referring to FIGS. 4 and 5, plan views of the first and second linking mechanisms 62, 70 are illustrated. The contoured plate 63 has a cylindrical opening at which it is secured to the inner shaft 35 and also has four arms **63*a*–63*d* (letter suffixes are used to identify repetitive parts). The bores 69 through the plate 63 are located on the circumference of a bore circle 75, the center of which is at the axis 56, and each of the bores 69 is angularly equidistantly spaced along the bore circle 75. The axis 68 along which the end portions 67 of the eccentric pins 64 extend is illustrated, although for the sake of clarity, the lugs 60 are not seen in FIG. 4. Concavities 76 in the inside wall of the cylinder 51 may be provided to accommodate the ends of the arms 63*a*–63*d*, for example, as is seen with respect to the arm 63*c***.

In the second linking mechanism 70 illustrated in FIG. 5, the relative orientation of the circular plan displacement shank 57, bearing sleeve 71, and contour plate 72 is seen. The four bores 74*a*–74*d* are centered on a further bore circle 77 that is of the same diameter as the bore circle 75 mentioned above but has its center located on the axis 58. The bores 74*a*–74*d* are angularly equidistantly spaced along the bore circle 77 and generally are positioned in fixed alignment with the bores 61 in respective vertically aligned lugs 60 (not shown in FIG. 5). As the outer shaft 36 rotates, it will be appreciated that axis 58 will travel in a circle illustrated in phantom at 78 around the axis 56.

The intended motion imparted to the hypocycloidal mandrel 7, referring to FIG. 5, is as follows. Rotation of the inner shaft 35, for example, in a counterclockwise direction, will tend to rotate the mandrel cylinders 50, 51 counterclockwise, too. The outer shaft 36, though, including the shank 57 rotates in a clockwise direction. Such clockwise rotation will tend to maintain a line of contact between the surfaces of the outer cylinder 50 and the surface of the inner annulus 16, whereby the outer cylinder 50 tends to roll around the internal surface of the inner annulus 16 causing such line of contact, which is substantially parallel to the other axes mentioned above, to travel about the circular plan of surface, as is seen in FIG. 5, for example.

From the foregoing it will be evident that the hypocycloidal mandrel 7 is attached to the inner shaft 35 by a series of levers or lever arms 63*a*–63*d* of the plate 63 and eccentric pins 64. Further levers represented, for example, by the respective apices of the plate 72, which have the same geometric bore location as the levers 63*a*–63*d* effectively fixedly mounted to the inner shaft 35, rotate freely on the shanks 57; such levers are connected to the corresponding inside bores 61 of respective lugs 60 by the straight pins 74*a*–74*d*. As is seen in FIGS. 2–5, the eccentricity of the eccentric pins 64 (and thus the spacing of the axes 66, 68), and the spacing of the axes 56, 58 (and thus the spacing of the center of the circular shaft 35, which also is the center of the bore circle 75, and the center of the circular shank 57, which also is the center of the bore circle 77) are equal. Such equality permits the desired complex rotation and translation effective in the movement of the hypocycloidal mandrel 7.

If both shafts 35, 36 are rotated in relatively opposite directions, such that the product of the angular velocity of the inner shaft 35 and the distance of the bores 69 of the levers 63*a*–63*d* from the axis 56 is equal to the product of the angular velocity of the outer shaft 36 and the eccentricity, for example the distance between the axes 56, 58, then the axes 68 of the respective bores 61 in the lugs 60 of the hypocycloidal mandrel will trace a hypocycloidal curve. All of the mentioned levers and connecting points to the shafts 35, 36 and to the mandrel structure 7 have to be such that the bore axes follow the path of the same predescribed hypocycloid.

For stable optimum operation the ratio of the radius of the bore circles 75, 77 for the respective levels mentioned to the eccentricity should be a natural number. The line of contact between the mandrel 7 and the casting 2, then, will return to its original position after successive full rotations of the mandrel equal to such ratio. The design of the hypocycloidal mandrel 7 can be simplified significantly by selecting the ratio of the radius of bore circle to eccentricity as an even number and by using the contoured plates 63, 72, as described, to provide the desired lever connections between the mandrel and the respective shafts 35, 36. The number of bores for straight and eccentric pins for any given contoured plate 63 or 72, should be an even number and preferably should be the same as the mentioned ratio; this number of bores may be reduced but should not be so small that the stability of the mandrel 7 would be impaired.

The number of hypocycloids traced by the respective bore axes is the number of the mentioned ratio plus one. Moreover, the ratio selected will determine the outside diameter of the hypocycloidal mandrel 7 and the number of rotations of the respective shafts 35, 36 during operation. For example, the outside diameter of the mandrel 7 should be equal to the inside diameter of the hollow round casting 2, say where such casting initially leaves the area of the fixed mandrel 6 and comes into contact with the hypocycloidal mandrel 7, minus twice the eccentricity. One rotation of the mandrel 7 is obtained by rotating the outer shaft 36 360° while rotating the inner shaft in the relatively opposite direction by an amount of 360° divided by the selected ratio.

For example, assume that the inside diameter of the casting 2 were 4 inches and the speed of the mandrel were 300 rotations per minute, i.e. the line of contact between the mandrel and the surface of the inner annulus 16 were intended to travel around the circumference of such surface 300 times per minute. Assume further that the eccentricity were selected to be 0.140625 inch and the radius of the bore circle for the contoured plates 63, 72 were selected at 1.125 inches. The ratio, then, would be 1.125 divided by 0.14062 and would equal 8. Therefore, for each complete rotation of the inner shaft 35, the outer shaft 36 must make eight rotations for every point at the circumference of the mandrel 7 to return to its original position while tracing nine hypocycloids relative to the inner circumference of the casting 2. Thus, 300 rotations per minute for the mandrel would require the outer shaft 36 to rotate 300 times per minute and the inner shaft 35 to rotate 45 times in that same time period.

Thus, the ratio of the rotational frequencies of the two shafts 35, 36 is eight, the same as the mentioned selected ratio. Also, although each contoured plate would be connected by eight pins to the mandrel inner cylinder 51, it would be possible to reduce the number of those connections to, for example, four in order to simplify the structure and to minimize space requirements.

In the example illustrated in the drawings, there are four connections of each contoured plate 63, 72 to the inner cylinder 51 of the mandrel structure 7. In this preferred embodiment of the invention, then, the selected ratio mentioned above would be four and, accordingly, five hypocycloids will be traced by each axis 68 at the circumference of an imaginary circle coupling the cusps of the hypocycloids before each axis returns to its original position.

Figure 6:
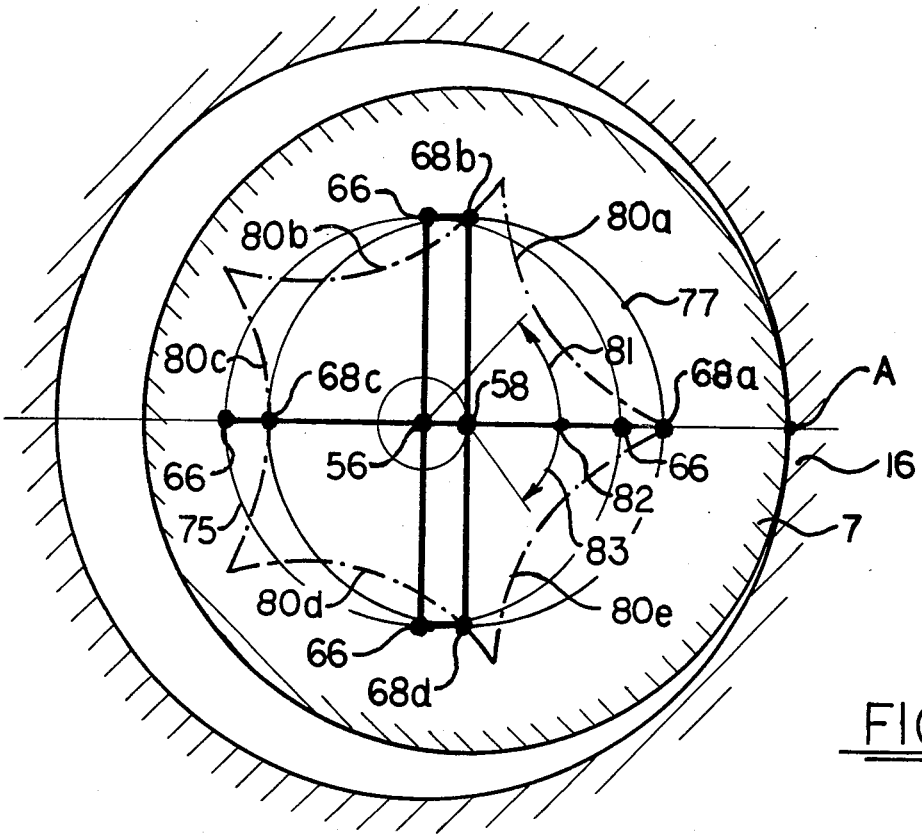
FIGS. 6 and 7 schematically depict the kinematics of the hypocycloidal mandrel.
Figure 7:
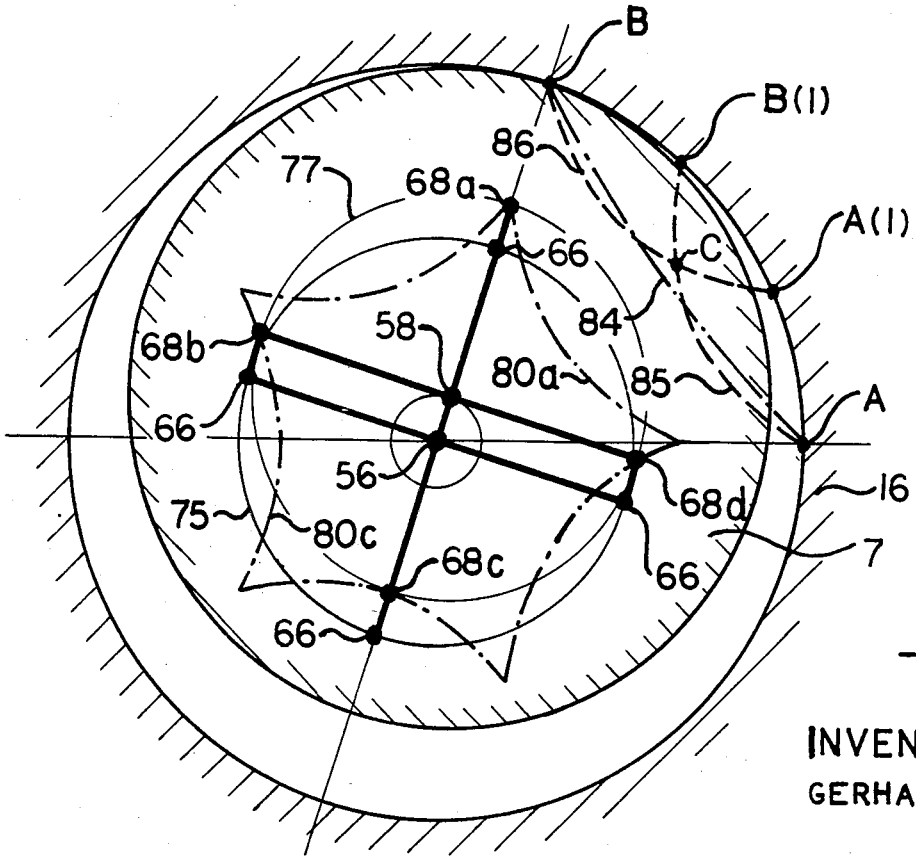

The rolling movement of the outside surface of the hypocycloidal mandrel 7 at the surface of the inner annulus 16 of a casting 2 is illustrated in FIGS. 6 and 7. The distance between axes 66 and 68 is the eccentricity of the eccentric pins 64 and is equal to the distance between the common axis 56 of the shafts 35, 36 and the center axis 58 of the shanks 57.

Referring to FIG. 6, at the original relative positions of the mandrel 7 and inner annulus 16 such that there is a line of contact therebetween symbolized at the point A, the axis 68*a* of one axially aligned group of lugs 60 is at the cusp of two adjacent hypocycloids 80*a*, 80*e*. The axes 68*b*, 68*c*, 68*d* of the other three groups of respectively axially aligned lugs 60 also are located on the paths of respective hypocycloids 80*b*, 80*c*, 80*d*. The outside diameter of the mandrel 7 and the inside diameter of the inner annulus 16 are in contact along the line A, as was mentioned. This is the area at which highly efficient cooling of the inner annulus 16 occurs due to direct surface to surface conduction. As the inner shaft 35 rotates, say counterclockwise, by an angle 81 from the original position 82 the outer shaft 36 rotates clockwise by an angle 83 from the original position 82. The amount of rotation or magnitude of angle 83 must be four times that of the angle 81 during the same time interval, e.g. if the angle of rotation 81 were 72° counterclockwise, then the angle of rotation 83 must be 288° clockwise. Such relation between angles of rotation is based on constant respective rotational frequencies of inner and outer shafts with the ratio of such rotational frequencies being four, as was discussed above.

During the mentioned 72° of counterclockwise rotation of the inner shaft 35 and the 288° of clockwise rotation of the outer shaft 36, the axis 68*a* traces the first hypocycloid 80*a* and travels to the next cusp of the five hypocycloids shown in FIGS. 6 and 7 arriving to the position shown, then, in FIG. 7. During such rotation of the shafts 35, 36, the axes 68*b*, 68*c*, 68*d* also travel on respective hypocycloidal curves 80 to the respective positions shown in FIG. 7. Since the radial distance of each axis 68 to the outside diameter of the mandrel 7 is equal and the mandrel structure itself is a rigid body, the hypocycloids 80 traced by the axes 68 may be considered translated to the outside diameter or surface of the mandrel 7. Subsequently, when the mandrel 7 rolls from engagement with the inner annulus 16 along line of contact represented by point B in FIG. 7 in a clockwise direction along the surface of the inner annulus 16 tracing of hypocycloidal curves 80 will continue in a counterclockwise direction. It will be appreciated that the translation of the hypocycloids from the axes 68 to the outside surface of the mandrel 7 is not a true translation. More specifically, since the curve 84 actually is not a hypocycloid, some slipping will occur between the surface of the mandrel and the surface of the inner annular 16. However, if the mandrel 7 were to roll without any slip inside the inner annulus 16, the curve traced by any point on the outside of the mandrel body 7 would be the hypocycloid 85 or 86, for example. Thus, point A would travel to point B(1); point A(1) would travel to point B; and point C would be the point of intersection of the two hypocycloids.

Ordinarily the slip between the two surfaces would be minimal. However, further minimization can be effected by adjustably controlling the relative speed of the motors 22, 23, say be silicon-controlled-rectifier means or other conventional means. By such adjustment curve 84 would tend to approach or to coincide with curve 85 from point A to point C and to coincide with curve 86 from point C to point B.

Referring back to FIGS. 2 and 3, cooling water is fed through pipe 90 in the housing 26 to bore 91 of the inner shaft 35. A rotary pressure joint 92 connects the stationary pipe 90 to the rotating shaft 35. The water is distributed to the gap 53 of the mandrel structure 7 by channel 93 at the bottom of the mandrel. The boundaries of channel 93 are cap 55 at one side and plates 94 and 95 at the other side. Plate 94 is rigidly connected to inner cylinder 51 and plate 95 is rigidly connected to the inner shaft 35. Seals between the faces of plate 94 and 95 prevent leakage of water. Transition from the movable mandrel 7 to the housing 26 is by channel 96, which is part of the mandrel 7 to channel 97. Channel 97 is an integral part of cap 98 which is part of the housing 26. Seals 99 confine the water to channel 96 and 97. Exit of water is by opening 100 of the housing 26. Arrows 54 in FIGS. 2 and 3 indicate the flow of water as described but the flow could be reversible. Moreover, as is seen in FIG. 2, the water also may provide cooling for the fixed mandrel 6. Water flow may be provided by pump means, not shown.

Figure 8:
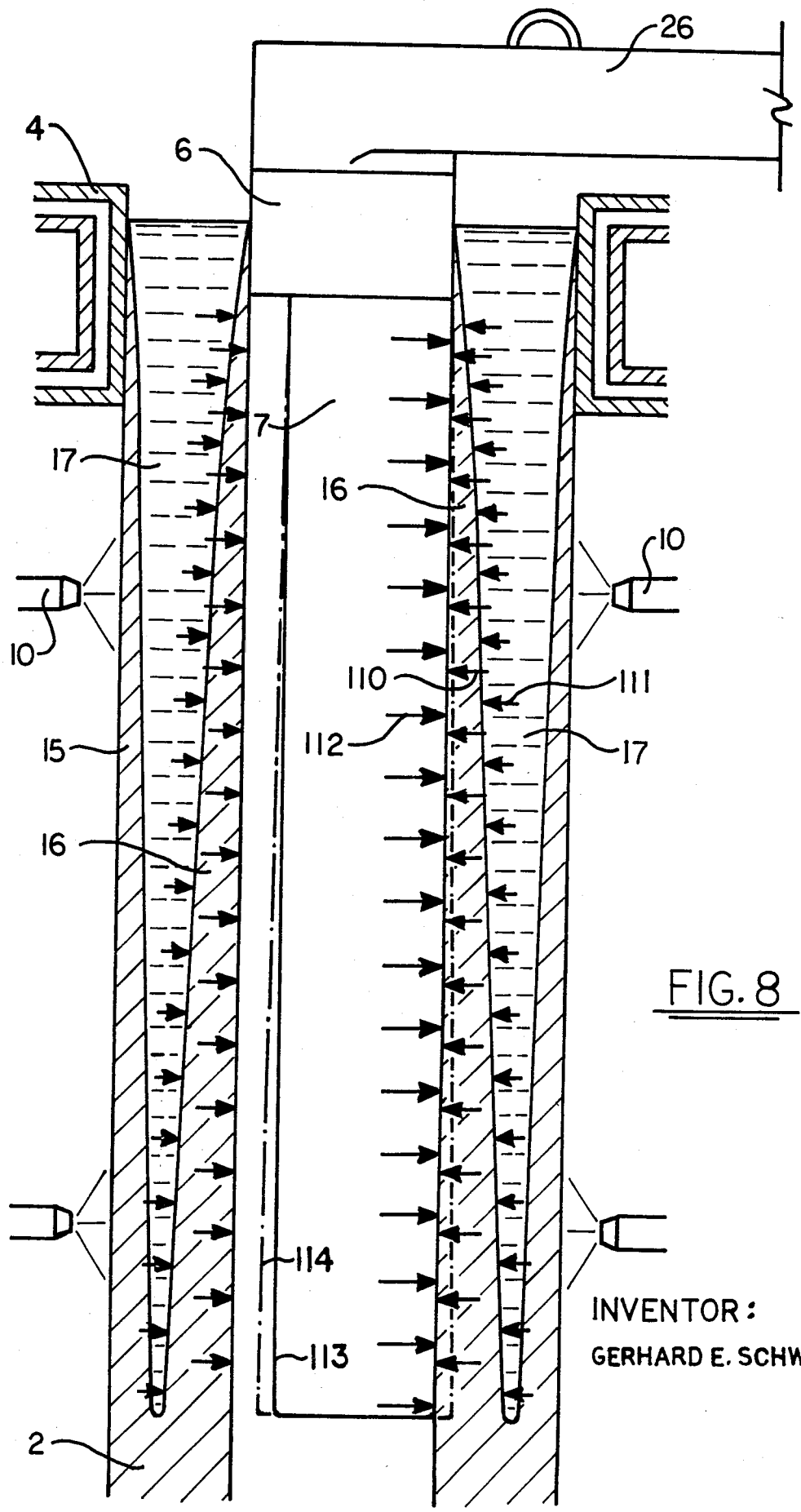
FIG. 8 is a schematic partial view of the casting machine showing the application of forces for the deformation of the inner annulus by the inside rolling process.

FIG. 8 indicates the deformation of the inner annulus 16 during the casting of the hollow round billet 2 to increase the ductility of the steel. As heat is extracted from the inner annulus 16 by the water cooled hypocycloidal mandrel 7 the inner annulus 16 cools and tries to contract exerting forces 110. In addition the ferrostatic pressure 111 of the liquid steel 17 acts on the outside surface of the inner annulus 16. Both forces, the shrinking forces 110 and the ferrostatic pressure 111 act in the same direction and are additive. Counteracting forces 110 and 111 are the reactive forces 112 of the mandrel 7 at the line of contact between the hypocyloidal mandrel 7 and inside surface of inner annulus 16. Since the direction of the forces is normal to their line of action the as-cast macrostructured steel of the inner annulus 16 is deformed by compression only. The amount of deformation and deformation rate can be controlled by the rolling speed of mandrel 7, the length of mandrel 7, and the outside shape of mandrel 7, which can be cylindrical as outlined by line 113 or tapered as outlined by line 114.

Figure 9:
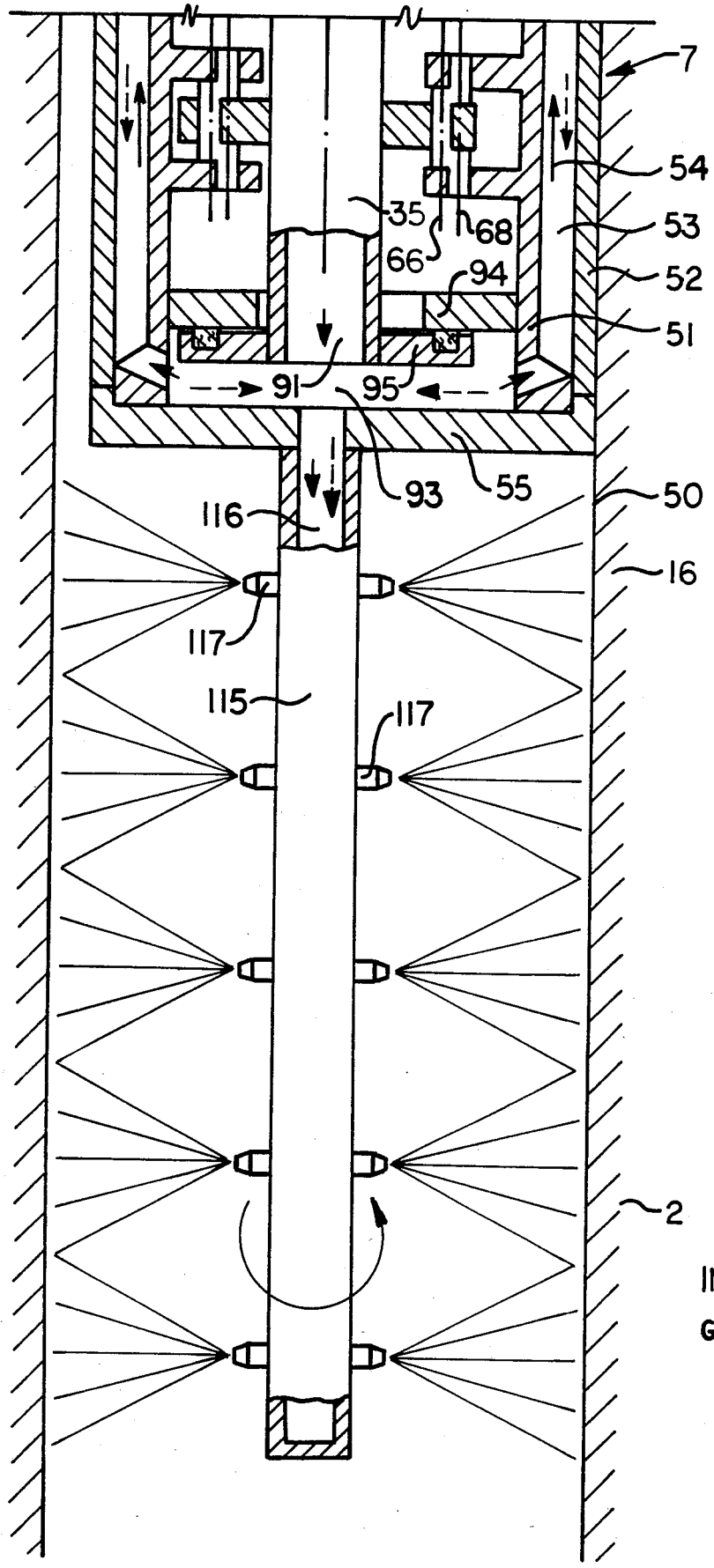
FIG. 9 is a schematic partial view of the hypocycloidal mandrel with an extension pipe for inside spray cooling of the cast hollow round.

If additional inside spray cooling is desired for casting hollow round steel billets 2, the hypocycloidal mandrel 7 could be modified as shown in FIG. 9. A pipe extension 115 is added to cap 55. The pipe extension 115 is closed at the bottom but has opening 116 connecting to channel 93 of the mandrel 7. The pipe extension 115 is rotated with the mandrel 7 and is equipped with spray nozzles 117. Feeding of the spray nozzles could be either through bore 91 of the inner rotating shaft 35 or through gap 53 of the mandrel 7. Feeding through bore 91 would divide the incoming cooling water to channel 93 and gap 53 for mandrel-cooling and opening 116 for spray cooling. Feeding through gap 53 could apply the total amount of cooling water for mandrel-cooling first, followed for the use of spray cooling. In this case the inner shaft 35 may be a solid shaft. Solid and dotted arrows in FIG. 9 indicate the flow of water as proposed in either case. Rotation of nozzles 117 causes the spray pattern at the inside wall of inner annulus 16 to be uniform avoiding hot spots at the inside surface of the hollow round steel billet 2 which could be detrimental to further processing to finished pipes.

Variations in scope and spirit of the described preferred embodiment could be construed and are therefore included in this invention. Furthermore, the steels cast by the preferred embodiment would be of grades used for the manufacture of steel pipes, but all manufactured items made of ferrous, non-ferrous and plastic material for which this invention could be applicable are also included in the spirit and scope thereof.

I claim:

1. Apparatus for casting hollow billets, comprising mold means and mandrel means for defining boundaries within which at least substantially molten material may at least partially initially solidify as a casting body having substantially solid exterior and interior surfaces, said mandrel means including a rotatable mandrel body positioned in a hollow interior portion of such casting body and having a curved exterior surface and means for rotating and translating said mandrel body in generally hypocycloid-like manner within such casting body thereby to effect substantial rolling engagement of said mandrel body with such interior surface of the casting body, whereby the interior of such hollow casting body accordingly will have a larger cross-sectional dimension than the cross-sectional dimension of said mandrel body.

2. The invention of claim 1, further comprising means for conducting cooling fluid through said mandrel body to cool the exterior surface thereof.

3. The invention of claim 1, said mandrel body having an elongate axis, and said means for rotating and translating comprising means for rotating said mandrel body about such elongate axis.

4. The invention of claim 3, said means for rotating and translating further comprising means for translating said mandrel body to effect rotation of such elongate axis about a further elongate axis.

5. The invention of claim 4, said means for rotating and translating further comprising respective means for independently controlling the speed of rotation and translation of said mandrel body.

6. The invention of claim 4 wherein said mandrel body is outwardly tapered going from its upstream to downstream ends.

7. The invention of claim 1, said means for rotating and translating comprising plural independently rotatable shafts positioned coaxially and internally of said mandrel body, and means for connecting each shaft to said mandrel body.

8. The invention of claim 7, said means for connecting comprising an eccentric cam-like member for connecting one of said shafts to said mandrel body and eccentric pin means for connecting the other of said shafts to said mandrel body.

9. The invention of claim 8, wherein the eccentricity of said cam-like member and of said eccentric pin means is substantially the same.

10. The invention of claim 9, said means for rotating and translating including means for controlling the speed of rotation and translation such that the product of the angular velocity of said other of said shafts and the distance of said eccentric pin means from the axis of said other of said shafts is equal to the product of the angular velocity of said one of said shafts and eccentricity of said cam-like member.

11. The invention of claim 1, said means for rotating and translating comprising means for maintaining a substantially continuous straight line contact between said mandrel body and such interior surface of such hollow casting.

12. The invention of claim 1, said mandrel body being generally elongate and of tapered cylindrical shape.

13. The invention of claim 7, said means for rotating and translating comprising means for rotating each of said shafts independently of the other and means for controlling the respective rotational speeds of said shafts to obtain rolling motion of said mandrel body, thereby to provide relatively controlled slippage between said mandrel body and the interior surface of such hollow casting.

14. The invention of claim 1, further comprising downstream spray extension means coupled to said mandrel body for receiving and directing cooling fluid onto the interior surface of such casting body.

15. The invention of claim 14, further comprising flow path means through said mandrel body to conduct fluid through the latter and to said extension means.

16. Apparatus for casting hollow billets, comprising primary mold means for defining boundaries within which at least substantially molten material may at least partially initially solidify as a casting body having substantially solid exterior and interior surfaces, and rotating and translating mandrel means for applying a line of force essentially only in a radially outward direction, such thusly applied line of force thereby tending to urge the interior surface of such casting body toward the exterior surface of such casting body without applying significant tangential forces to the interior surface of such casting body said mandrel means comprising a rotating mandrel positioned in a hollow interior portion of such casting body, and means for rotating and translating said mandrel within such casting body such that point on the circumference of said mandrel generate hypocyloid—like curves.

17. Apparatus for casting hollow billets, comprising primary mold means for defining boundaries within which at least substantially molten material may at least partially initially solidify as a casting body having substantially solid exterior and interior surfaces, a rotating mandrel positioned in a hollow interior portion of such casting body, means for conducting cooling fluid through said mandrel, and means for rotating and translating said mandrel within such casting body such that points on the circumference of said mandrel generate hypocycloid-like curves whereby such casting body will be conductively cooled at such interior surface thereof without substantially impeding movement of such casting body through such apparatus.

18. The apparatus of claim 17, further comprising means for directing cooling fluid onto the interior and exterior surfaces of such casting body to cool the same.

19. The apparatus of claim 17, further comprising means for conducting cooling fluid through both said primary mold means and said mandrel to effect cooling thereof and, accordingly, cooling of the interior surface of such casting body by conduction.

20. The apparatus of claim 17, further comprising seal means between said primary mold means and said mandrel for permitting relative movement therebetween while sealing the area of such relative movement, thereby to block flow of molten material into the interior of said primary mold means or mandrel.

21. The apparatus of claim 17, said primary mold means comprising a fixed annular mold and an internal relatively fixed mandrel, and said rotating mandrel being positioned relatively downstream of said fixed mandrel.

22. Apparatus for casting hollow billets, comprising a fixed annular mold and an internal relatively fixed mandrel which respectively define boundaries within which molten material may initially solidify as a casting body, a rotating mandrel positioned relatively downstream of said fixed mandrel, means for rotating and translating said mandrel in generally hypocycloidal-like manner within the casting body thereby to effect substantial rolling engagement of said mandrel with such interior surface of the casting body, and means for conducting cooling fluid first through said rotating mandrel and then through said fixed mandrel.

23. Apparatus for casting hollow billets, comprising a fixed annular mold and an internal relatively fixed mandrel which respectively define boundaries within which molten material may initially solidify as a casting body, a rotating mandrel positioned relatively downstream of said fixed mandrel, means for rotating and translating said mandrel in generally hypocycloid-like manner within the casting body thereby to effect substantial rolling engagement of said mandrel with such interior surface of the casting body, spray means positioned relatively downstream of said rotating mandrel for receiving and directing cooling fluid onto the interior surface of the casting body, and means for conducting cooling fluid first through said fixed mandrel, then said rotating mandrel, and then said spray means.

24. A method of casting hollow round billets, tubes or other castings, comprising supplying at least substantially molten material to a first generally annular mold, allowing such material to move through such generally annular mold while at least exterior and interior generally solid surfaces form on such casting, and rolling such internal surface, said last step including rotating and translating a mandrel in the hollow interior of such casting in generally hypocycloid-like manner to effect substantial rolling engagement of said mandrel with the interior surface of such casting.

25. The method of claim 24, further comprising controlling the speed of rotation and translation of the mandrel thereby to control slip between such mandrel and the interior surface of such casting.

26. The method of claim 24, further comprising spraying cooling fluid on the interior surface of such hollow casting.

27. The method of claim 26, further comprising spraying cooling fluid on the exterior surface of such hollow casting.

28. A method of casting hollow round billets, tubes or other castings, comprising supplying at least substantially molten material to a first generally annular mold, allowing such material to move through such generally annular mold while at least exterior and interior generally solid surfaces form on such casting, and applying compressive force to such interior surface, said last step including rotating and translating a mandrel in the hollow interior of such casting in generally hyocycloid-like manner to effect substantial rolling engagement of said mandrel with the interior surface of such casting.

29. A method of casting hollow round billets, tubes or other castings, comprising supplying at least substantially molten material to a first generally annular mold, allowing such material to move through such generally annular mold while at least exterior and interior generally solid surfaces form on such casting, and cooling such interior surface by conduction without appreciably restricting movement of such casting through such mold, said last step including rotating and translating a mandrel in the hollow interior of such casting in generally hypocycloid-like manner to effect substantial rolling engagement of said mandrel with the interior surface of such casting.

30. The method of claim 29, comprising rotating the mandrel about a central elongate axis thereof and further translating the mandrel to effect rotation of such elongate axis about a further elongate axis parallel to and offset from such elongate axis.

31. The method of claim 30, wherein the mandrel is connected to first and second shafts positioned coaxially and internally thereof by an eccentric cam-like member and eccentric pin means, respectively, and comprising controlling the speeds of rotation of such shafts such that the product of the angular velocity of such second shaft and the distance of the eccentric pin means from the axis of such second shaft is equal to the product of the angular velocity of such first shaft and eccentricity of the cam-like member.

* * * * *